US006196671B1

(12) United States Patent
Breemes, Sr. et al.

(10) Patent No.: US 6,196,671 B1
(45) Date of Patent: Mar. 6, 2001

(54) INK-JET CARTRIDGE FOR AN INK JET PRINTER HAVING AIR INGESTION CONTROL

(75) Inventors: David P. Breemes, Sr., Palmyra, NY (US); Raymond P. Mileski, Avon, NC (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/467,474

(22) Filed: Dec. 20, 1999

(51) Int. Cl.[7] ..... B41J 2/175
(52) U.S. Cl. ..... 347/86
(58) Field of Search ..... 347/85, 86, 87, 347/92

(56) References Cited

U.S. PATENT DOCUMENTS

| | | | |
|---|---|---|---|
| Re. 32,572 | 1/1988 | Hawkins et al. | 156/626 |
| 4,571,599 | 2/1986 | Rezanka . | |
| 4,771,295 | 9/1988 | Baker et al. . | |
| 4,833,491 | 5/1989 | Rezanka . | |
| 5,185,614 | 2/1993 | Courian et al. . | |
| 5,486,855 | 1/1996 | Carlotta et al. | 347/87 |
| 5,805,187 * | 9/1998 | Sasaki | 347/86 |
| 5,821,966 | 10/1998 | Schell et al. | 347/86 |
| 6,042,224 * | 3/2000 | Oda et al. | 347/86 |

* cited by examiner

*Primary Examiner*—N. Le
*Assistant Examiner*—Anh T. N. Vo
(74) *Attorney, Agent, or Firm*—David J. Arthur

(57) ABSTRACT

An ink jet cartridge for an ink jet printer has a housing for the installation of at least one replaceable ink supply tank. The cartridge has a printhead attached thereto which is in fluid communication with an ink pipe connector integrally formed on the floor of the housing through a passageway in the floor. The ink pipe connector protrudes from the housing floor and is adapted to enter an outlet port of the ink supply tank when the supply tank is installed in the housing. The ink pipe connector has a mesh filter recessed therein and a cover having holes therein positioned over the entrance of the ink pipe connector and spaced above the filter to form an internal chamber in the ink pipe connector. The holes in the cover are sufficiently small to cause the formation of an ink meniscus in each hole when the chamber is filled with ink and the meniscus in the holes prevent the ingestion of air.

14 Claims, 3 Drawing Sheets

INK-JET CARTRIDGE FOR AN INK JET PRINTER HAVING AIR INGESTION CONTROL

BACKGROUND OF THE INVENTION

The invention relates to ink jet printing devices and more particularly to an ink cartridge for an ink jet printer having customer replaceable ink supply tanks and air ingestion control.

Ink jet printing devices may include one or more printheads which eject ink onto a print medium, such as paper, in controlled patterns of closely spaced dots or pixels. To form color images, a printhead may have segregated groupings of nozzles, one group for each color or multiple printheads may be used, with each printhead being supplied with ink of a different color from associated ink supply tanks. For carriage type multicolor printers, which reciprocate back and forth across a stationary print medium to print a swath of information, one or more printheads are sealingly attached to a cartridge containing several replaceable ink supply tanks, generally one tank for each color of ink. The cartridge is mounted on a movable carriage which is translated back and forth along guide rails. Each time the cartridge traverses across the print medium, a swath of information is printed while the print medium is held stationary and then is stepped a distance of the height of the printed swath, so that the next swath may be contiguously printed against the previously printed swath. This procedure is continued until an entire page is printed.

Ink from each of the ink supply tanks is drawn by capillary action through an outlet port in the respective tank and into a respective passageway in the floor of the cartridge fluidly connecting ink to the designated printhead . The passageway supplies ink to the printheads from the respective ink tank replenishing the ink after each ink droplet ejection from the printhead nozzles. In order to obtain a more effective withdrawal of ink from an ink tank, it is known to project an ink pipe into the ink container so as to withdraw either liquid ink or ink from an impregnated foam member. U.S. Pat. No. 4,771,295 is representative of this type of ink withdrawal system.

It is well known that customers or users of ink jet printers may have ink cartridges with permanently fixed printheads and replaceable ink supply tanks. For existing multicolor ink jet printers, it is not uncommon for the printer to deplete ink from many ink supply tanks of each color before having to replace the cartridge and its attached printhead. One problem with the replacement of depleted ink tanks, is that when the filters required to filter the ink are recessed in the ink pipes, an air pocket is formed in the ink pipe above the filter when the depleted tanks are removed. When the new tank is installed, the air over the filter is trapped in the ink pipe between the filter and the foam in the ink tank. As soon as the printhead is re-primed, as is necessary each time the ink tank is removed, the trapped air is drawn into the printhead's reservoir and/or capillary ink channels where it is trapped and causes an interruption of capillary flow, thus causing at least some of the nozzles to misfire, if not total deprime of the printhead.

SUMMARY OF THE INVENTION

It is the object of the present invention to prevent air from entering the recessed filter located in the ink pipe connectors of the ink jet cartridge when ink tanks are replaced by maintaining a layer of ink over the filter, so that air ingestion by the printhead is prevented.

In one aspect of the invention, there is provided an ink jet cartridge for an ink jet printer having a printhead and at least one replaceable ink supply tank in fluid communication with the printhead, comprising: a housing having said printhead fixedly attached thereto, a floor containing an ink passageway, and at least one ink pipe connector protruding from said floor, the passageway having an outlet sealingly connected to the printhead and an inlet integrally connected to said at least one ink pipe connector, said at least one pipe connector having an ink entrance in the portion thereof protruding from said floor, a mesh filter internally recessed from the ink entrance, and a cover closing the entrance and forming an internal chamber between said filter and the cover, said cover having a plurality of holes therethrough, the holes having a cross-sectional area sufficiently small to cause the formation of an ink meniscus when said chamber is filled with ink, thereby preventing the ink in the chamber from leaking out and air from entering the chamber through said holes, and at least one replaceable ink supply tank having an outlet port, said ink supply tank being installed on said cartridge floor with the ink pipe connector extending into said outlet port.

BRIEF DESCRIPTION OF THE DRAWINGS

The present invention will now be described by way of example with reference to the accompanying drawings, wherein like reference numerals refer to like elements and in which.

DESCRIPTION OF THE PREFERRED EMBODIMENT

Figure 1:
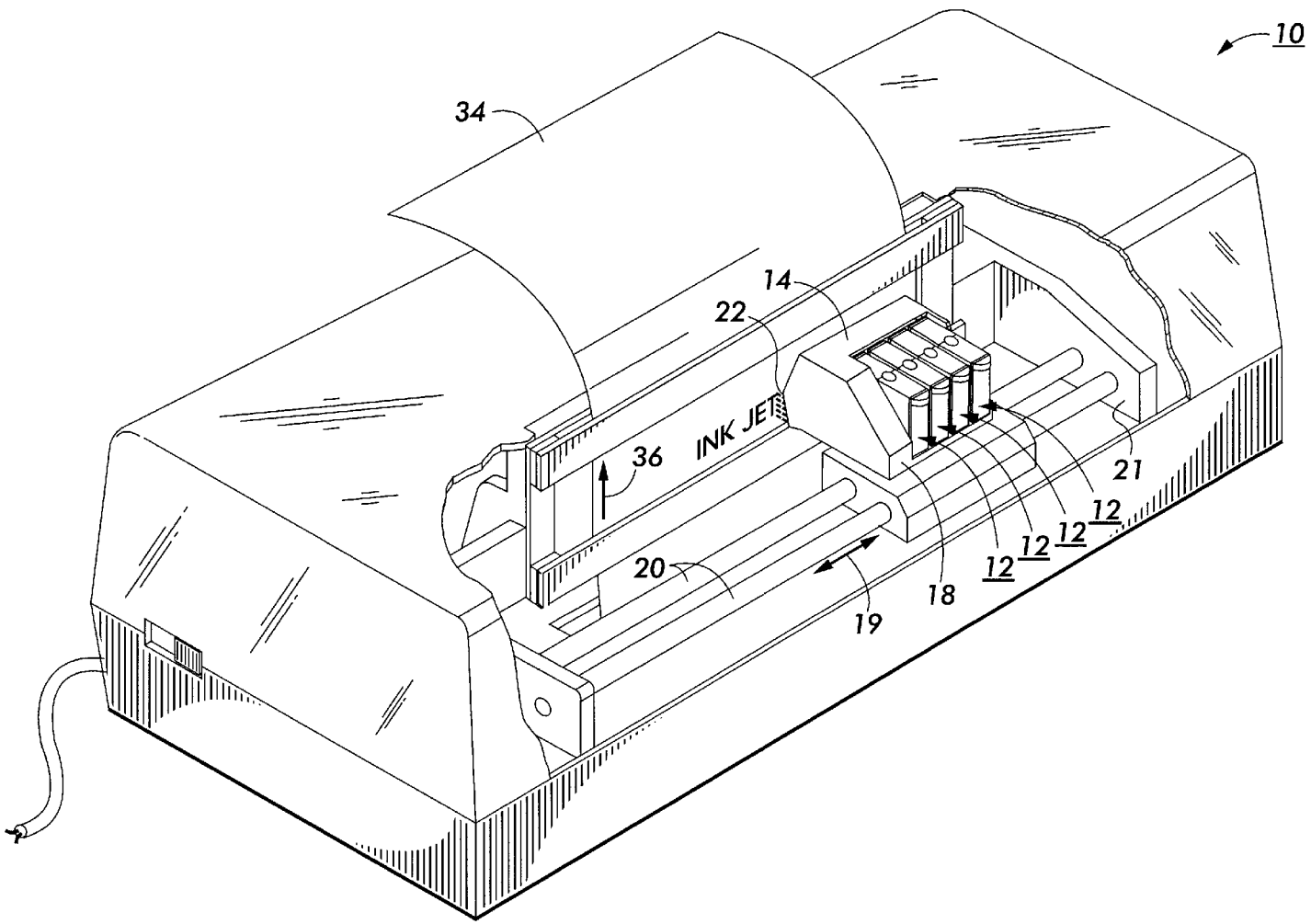
FIG. 1 illustrates an isometric view of a full color ink jet printer which incorporates the means for maintaining a layer of ink over the recessed filter in the ink pipe connector according to the present invention.

FIG. 1 illustrates an isometric view of a carriage type multicolor thermal ink jet printer 10 which incorporates a preferred embodiment of the means for preventing the entrance of air in the ink pipe connectors 24 (FIG. 2) of ink jet cartridge 14. The ink jet cartridge includes at least one permanently attached printhead 22 and four customer replaceable ink supply tanks 12 mounted therein, each tank contains a different color of ink, and in the preferred embodiment, the tanks have yellow, magenta, cyan, and black ink. As explained later, the ink tanks are in fluid communication with the printhead via ink passageways in the ink jet cartridge. The cartridge 14 is mounted on a carriage 18 supported by guide rails 20. The guide rails are supported by a frame 21 of the ink jet printer 10. The carriage 18 is translated back and forth along the guide rails by any suitable means (not shown), such as, for example, a timing belt driven by an electrical motor, as is well known in the printer industry. The droplet ejection from the printhead nozzles (not shown) and the movement of the carriage 18 are under the control of the printer controller (not shown), so that ink droplets are selectively ejected from the printhead nozzles in response to receipt of electrical signals from the controller through an electrical cable (not shown).

In the embodiment shown, the printhead 22 comprises one reservoir with inlet for each color of ink and a plurality of nozzles (neither shown), one segregated group of nozzles for each reservoir. The reservoirs are respectively interconnected with its associated groups of nozzles for a particular color of ink by a plurality of ink channels (not shown), one channel for each nozzle. Alternatively, a separate printhead could be provided for each color. Ink passageways 26 formed in the cartridge (FIG. 2) interconnect a particular ink pipe connector 24 with a selected reservoir inlet, so that ink is replenished by capillary action from the ink tanks through the printhead reservoirs and ink channels to the nozzles, as the ink droplets are ejected. When printing, the carriage 18 reciprocates back and forth along the guide rails 20 in the direction of arrow 19, the entire width of traverse constitutes a printing path. The actual printing zone is contained within the printing path. As the carriage 18 with the cartridge 14 and attached printhead 22 traverses the printing path and the printhead passes a recording medium 34, such as a sheet of paper or transparency, droplets of ink are expelled from selected ones of the printhead nozzles towards the recording medium. Typically, during each pass or traverse of the carriage 18, the recording medium is held stationary. At the end of each traverse, the recording medium is stepped in the direction of arrow 36. For a more detailed explanation of the operation of printer 10, reference is made to U.S. Pat. Nos. 4,571,599; 4,833,491; 5,821,966 and U.S. Reissue No. 32,572, which are incorporated herein by reference.

Figure 2:
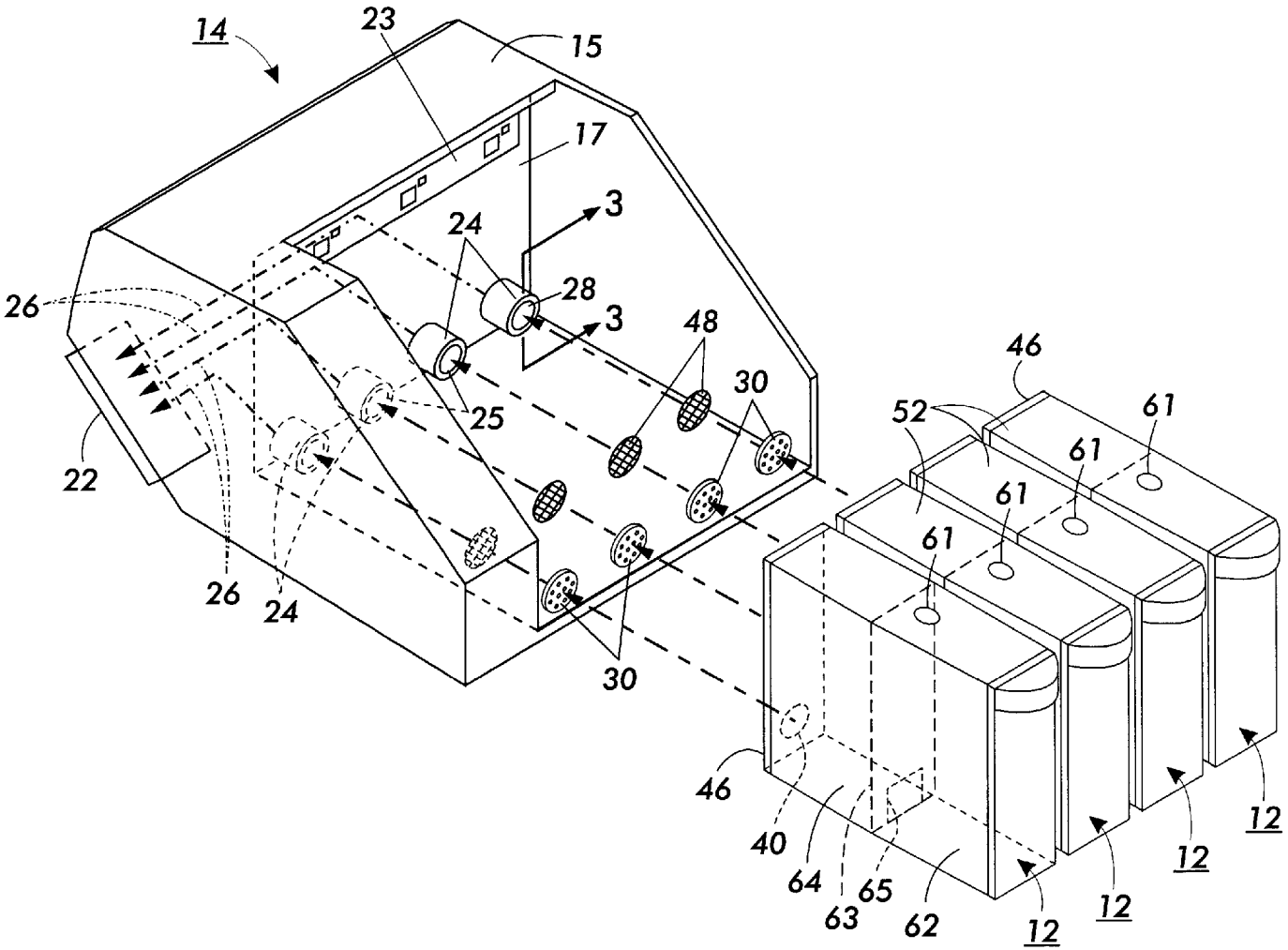
FIG. 2 is a partially exploded isometric view of the ink jet cartridge and replaceable ink supply tanks shown in FIG. 1.
Figure 3:
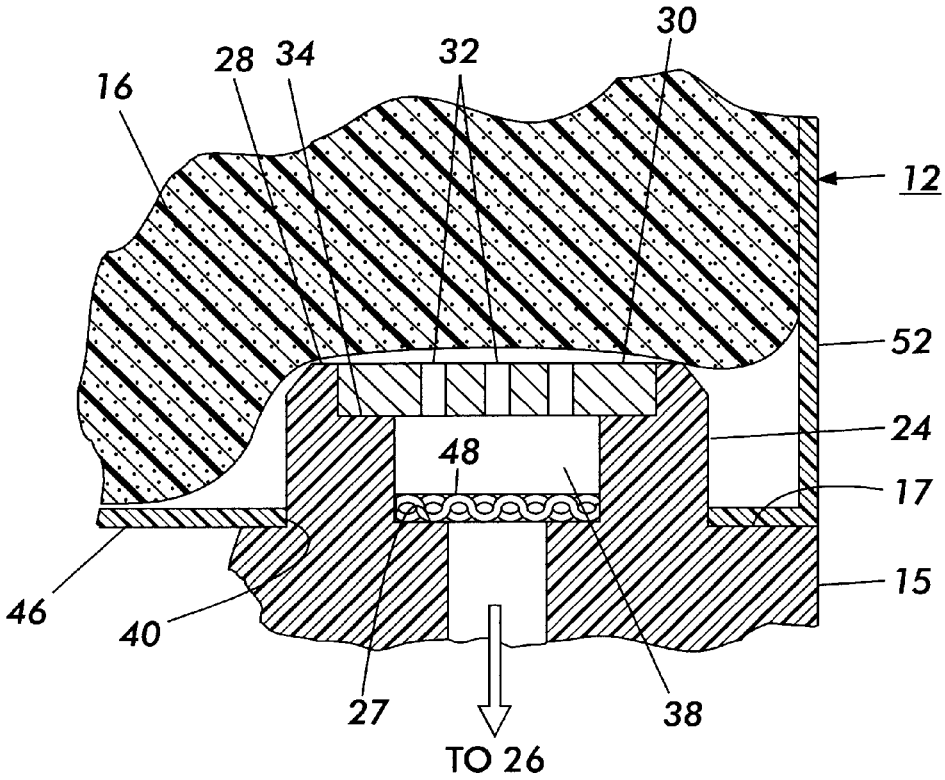
FIG. 3 is an enlarged, partially shown cross-sectional view of an ink pipe conner as seen along view line 3—3 shown in FIG. 2 with ink supply tank installed.

Referring also to FIGS. 2 and 3, the cartridge 14 comprises a housing 15 having an integral multicolor ink jet printhead 22 and ink pipe connectors 24 which protrude from a floor 17 of the cartridge for insertion into the outlet ports 40 of the ink supply tanks 12, when the ink supply tanks are installed in the cartridge. The protruding ink pipe connectors have a recessed wire mesh filter 48, which is spaced from the entrance 28 thereof to prevent particles or debris from the ink supply tanks from being carried by the ink into the printhead. For ease of positioning the filter 48, an internal shoulder 27 is provided at the desired depth below the ink pipe connector entrance 28. Ink flow passageways, represented by dashed lines 26, are integrally formed in the housing floor, one for each ink supply tank. The passageways interconnect respective ink pipe connectors with the separate printhead reservoir inlets (not shown) of the printhead. There is one printhead inlet for each passageway and thus one printhead inlet for each color. The cartridge 14 on which the replaceable ink supply tanks 12 are mounted, includes an interfacing printed circuit board 23 that is connected to the printer controller by a ribbon cable (not shown) through which electric signals are selectively applied to the printhead to selectively eject ink droplets from the printhead nozzles.

As disclosed above, ink from each of the ink supply tanks 12 is drawn by capillary action through the outlet port 40 in the ink supply tanks, the ink pipe connectors 24 which extend through the outlet port 40, and ink passageways 26 in the cartridge housing to the printhead 22. The ink pipe connectors and the passageways of the housing 15 thus supply ink to the printhead reservoir inlets and replenish the ink after each ink droplet ejection from the nozzles associated with that reservoir via ink channels interconnecting the nozzles and reservoir. It is important that the ink at the nozzles be maintained at a slightly negative pressure, so that the ink is prevented from dripping onto the recording medium 34, and ensuring that ink droplets are placed on the recording medium only when a droplet is ejected by an electrical signal applied to the heating element (not shown) in the ink channel for the selected nozzle. A negative pressure also ensures that the size of the ink droplets ejected from the nozzles remain substantially constant as ink is depleted from the ink supply tanks. The negative pressure is usually in the range of −0.5 to −2.0 inches of water. One known method of supplying ink at a negative pressure is to place within the ink supply tanks an open cell foam or needled felt 16 in which ink is absorbed and suspended by capillary action. Ink tanks which contain ink holding material are disclosed, for example, in U.S. Pat. Nos. 5,185,614; 4,771,295, and 5,486,855.

The ink supply tanks 12 for a carriage type ink jet printer 10 comprises a housing or container 52 of any suitable material, such as, for example, polypropylene, having first and second compartments 62,64 which are separated by a common wall 63. Ink is stored in the first compartment 62 after introduction therein through ink inlet 61 which is subsequently covered. The second compartment 64 has an open cell foam member 16 inserted therein. Ink from the first compartment moves through aperture 65 in the common wall 63 to saturate the foam member with ink. The foam member is inserted into the second compartment through the open bottom thereof, and then the open bottom is covered by a bottom wall 46 of the same material as the housing 52, after the foam member is inserted.

Figure 4:
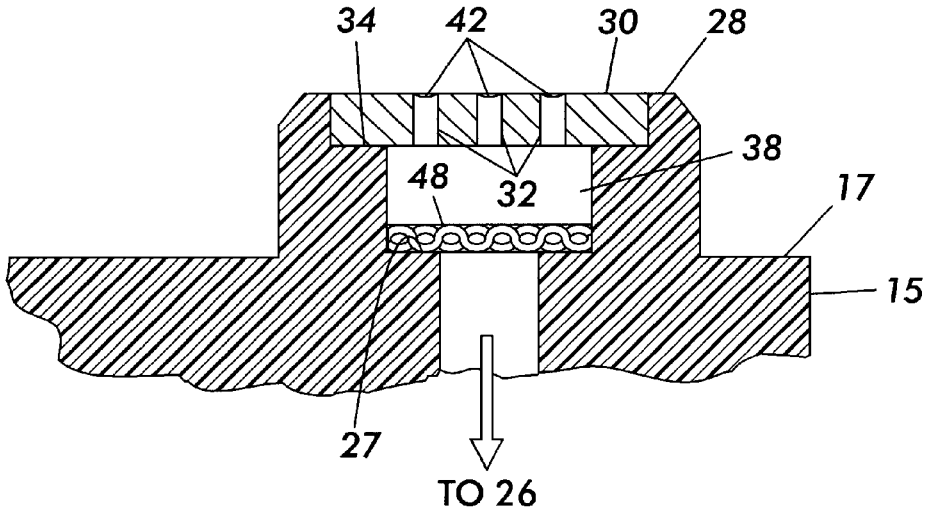
FIG. 4 is the same view as FIG. 3 with the ink supply tank removed.

When the ink supply tanks were removed and re-installed or when ink depleted tanks 12 were replaced, a pocket of air tended to form in the ink pipe connector above any ink residing on the filter 48 or on the filter itself. As soon as the ink pipe connector re-entered the outlet port 40 of the ink supply tank to contact the foam member 16, the air was trapped in the region between the filter and the ink pipe connector entrance 28. As soon as the printhead was primed by sucking ink from the nozzles, the trapped air was drawn into the printhead reservoir and/or ink channels with the result that capillary refill was prohibited in some, if not all of the ink channels, causing a failure mode for the printhead. As shown in FIGS. 3 and 4, a cross-sectional view of a one of the ink pipe connectors 24, a cover 30 placed over the ink pipe connector entrance having a plurality of holes 32 formed therethrough with a cross-sectional area sufficiently small to produce an ink meniscus 42 therein stops the air from passing though the holes and effectively provides an air dam or barrier. The cover may be placed over the ink pipe connector entrance 28 or, as shown, is positioned on a second shelf 34, so that the cover is in the same plane as the ink pipe connector entrance. When the cover is in place, a chamber 38 is formed between the cover 30 and the filter 48 which keeps the chamber filled with ink and the meniscus 42 prevents air from entering through the holes. It has been determined that cover having a thickness of 10 to 40 mils or 0.25 to 1 mm with holes having a diameter of about 0.25 mm provides the required ink meniscus which prevents the ink from entering the chamber. In the preferred embodiment, the internal diameter of the chamber in the ink pipe connector is about 2.5 to 5 mm and the chamber height is about 1 to 2 mm. Without the cover with the holes to provide an ink meniscus therein, air bubbles become a problem with the first ink supply tank replacement. With the cover, there were no air bubble problems after 15 ink supply tank removals and replacements when the printhead was primed and all nozzles ejected ink droplets without a misfire.

Although the foregoing description illustrates the preferred embodiment, other variations are possible and all such variations as will be obvious to one skilled in the art are intended to be included within the scope of this invention as defined by the following claims.

What is claimed is:

1. An ink jet cartridge for an ink jet printer having a printhead for use with at least one replaceable ink supply tank in fluid communication with the printhead, comprising:

a housing having said printhead fixedly attached thereto, a floor containing an ink passageway, and at least one ink pipe connector protruding from said floor, the passageway having an outlet sealingly connected to the printhead and an inlet integrally connected to said at least one ink pipe connector, said at least one pipe connector having an ink entrance in the portion thereof protruding from said floor, a mesh filter internally recessed from the ink entrance, and a cover closing the entrance and forming an internal chamber between said filter and the cover, and said cover having a plurality of holes therethrough, the holes having a cross-sectional area sufficiently small to cause the formation of an ink meniscus when said chamber is filled with ink, thereby preventing the ink in the chamber from leaking out and air from entering the chamber through said holes.

2. An ink jet cartridge for an ink jet printer, the cartridge comprising:

a housing having a printhead, an ink pipe connector protruding from the housing, and an ink passageway connecting the ink pipe connector with the printhead, wherein the ink pipe connector has an ink entrance in the portion thereof protruding from the housing, a mesh filter in the ink pipe connector, and a cover closing the ink entrance and forming an internal chamber between the mesh filter and the cover, wherein the cover has a plurality of holes therethrough, the holes having a cross-sectional area sufficiently small to cause the formation of an ink meniscus when the chamber is filled with ink.

3. The ink jet cartridge of claim 2, additionally comprising an ink supply tank having an outlet port, wherein the ink supply tank is installed on the cartridge with the ink pipe connector with the cover extending into the outlet port.

4. The ink jet cartridge of claim 2, wherein:

the mesh filter in the ink pipe connector is internally recessed from the ink entrance, and the cover forms an internal chamber in the ink pipe connects between the mesh filter and the cover.

5. The ink jet cartridge of claim 4, wherein the holes through the cover have a diameter of approximately 0.25 mm.

6. The ink jet cartridge of claim 5, wherein the cover has a thickness of between 0.25 mm and 1.0 mm.

7. An ink jet printer, comprising:

a frame;

a carriage mounted on the frame; and an ink jet cartridge carried on the carriage, the cartridge comprising:

a housing having a printhead, an ink pipe connector protruding from the housing, and an ink passageway connecting the ink pipe connector with the printhead, wherein the ink pipe connector has an ink entrance in the portion thereof protruding from the housing, a mesh filter in the ink pipe connector, and a cover closing the ink entrance and forming an internal chamber between the mesh filter and the cover, wherein the cover has a plurality of holes therethrough, the holes having a cross-sectional area sufficiently small to cause the formation of an ink meniscus when said chamber is filled with ink.

8. The ink jet printer of claim 7, additionally comprising an ink supply tank having an outlet port, the ink supply tank being installed with the ink pipe connector extending into the outlet port.

9. The ink jet cartridge of claim 7, wherein:

the mesh filter in the ink pipe connector is internally recessed from the ink entrance, and the cover forms an internal chamber in the ink pipe connects between the mesh filter and the cover.

10. The ink jet printer of claim 9, wherein the housing has at least one additional ink pipe connector protruding from the housing, and a corresponding number of additional ink passageways, each of which is connected to one of the additional ink pipe connectors.

11. The ink jet printer of claim 10, additionally comprising one or more ink supply tanks, each having an outlet port, wherein each of the ink supply tanks is installed on the cartridge with one of the ink pipe connectors extending into the outlet port of that ink supply tank.

12. The ink jet printer of claim 11, wherein the frame comprises guide rails, and the carriage is movably mounted on the guide rails.

13. The ink jet cartridge of claim 12, wherein the holes through the cover have a diameter of approximately 0.25 mm.

14. The ink jet cartridge of claim 13, wherein the cover has a thickness of between 0.25 mm and 1.0 mm.

* * * * *